US011141735B2

(12) United States Patent
Knight

(10) Patent No.: US 11,141,735 B2
(45) Date of Patent: Oct. 12, 2021

(54) REFINER PLATE WITH WAVE-LIKE GROOVE PROFILE

(71) Applicant: VALMET, INC., Duluth, GA (US)

(72) Inventor: Ryan A. Knight, Oconomowoc, WI (US)

(73) Assignee: Valmet Technologies Oy, Espoo (FI)

( * ) Notice: Subject to any disclaimer, the term of this patent is extended or adjusted under 35 U.S.C. 154(b) by 228 days.

(21) Appl. No.: 15/996,357

(22) Filed: Jun. 1, 2018

(65) Prior Publication Data

US 2018/0345291 A1 Dec. 6, 2018

Related U.S. Application Data

(60) Provisional application No. 62/515,430, filed on Jun. 5, 2017.

(51) Int. Cl.

| | |
|---|---|
| ***B02C 7/04*** | (2006.01) |
| ***D21D 1/30*** | (2006.01) |
| ***B02C 7/12*** | (2006.01) |

(52) U.S. Cl.

CPC ..... *B02C 7/04* (2013.01); *B02C 7/12* (2013.01); *D21D 1/306* (2013.01)

(58) Field of Classification Search

CPC ..... D21D 1/30; D21D 1/303; D21D 1/306; B02C 7/04; B02C 7/12

USPC ..... 241/261.2, 261.3

See application file for complete search history.

(56) References Cited

U.S. PATENT DOCUMENTS

| | | | | |
|---|---|---|---|---|
| 804,738 | A | 11/1905 | Kreps | |
| 827,059 | A | 7/1906 | Davis | |
| 992,000 | A * | 5/1911 | Kihlgren | B02C 7/12 241/261.2 |
| 1,609,717 | A | 12/1926 | Holland-Letz | |
| 3,411,720 | A * | 11/1968 | Jones | D21D 1/30 241/28 |
| 3,473,745 | A * | 10/1969 | Soars, Jr. | D21D 1/30 241/298 |
| 4,023,737 | A | 5/1977 | Leider et al. | |
| 4,166,584 | A * | 9/1979 | Asplund | D21D 1/30 241/261.3 |
| 4,712,745 | A * | 12/1987 | Leith | D21D 1/30 241/261.3 |
| 5,165,592 | A | 11/1992 | Wasikowski | |
| 5,362,003 | A | 11/1994 | Virving | |
| 5,425,508 | A | 6/1995 | Chaney | |
| 5,467,931 | A | 11/1995 | Dodd | |
| 5,683,048 | A | 11/1997 | Virving | |
| 5,690,286 | A | 11/1997 | Dodd et al. | |
| 5,695,136 | A | 12/1997 | Rohden | |

(Continued)

FOREIGN PATENT DOCUMENTS

GB 848569 A * 9/1960 ..... B02C 7/04

*Primary Examiner* — Debra M Sullivan
*Assistant Examiner* — Dylan Schommer
(74) *Attorney, Agent, or Firm* — James Earl Lowe, Jr.

(57) ABSTRACT

A refiner plate segment including a plurality of bars and grooves for refining lignocellulosic materials, where the grooves between adjacent bars includes a plurality of teeth having a wave-like profile with alternating high and low points. The wave-like profile of the teeth within the grooves increases turbulence in the refining process to tumble the fibers and push them toward the refining gap to reduce energy and improve the efficiency of the fiber reduction process.

15 Claims, 3 Drawing Sheets

(56) References Cited

U.S. PATENT DOCUMENTS

| | | | | |
|---|---|---|---|---|
| 5,836,525 | A * | 11/1998 | Garnier | D21D 1/306 241/28 |
| 6,032,888 | A * | 3/2000 | Deuchars | B02C 7/12 241/261.3 |
| 6,276,622 | B1 | 8/2001 | Obitz | |
| 6,325,308 | B1 * | 12/2001 | Lofgren | D21D 1/306 241/28 |
| 6,592,062 | B1 | 7/2003 | Virving | |
| 6,607,153 | B1 * | 8/2003 | Gingras | B02C 7/12 241/261.2 |
| 7,419,112 | B2 | 9/2008 | Sjostrom et al. | |
| 7,900,862 | B2 | 3/2011 | Gingras | |
| 8,157,195 | B2 | 4/2012 | Gingras | |
| 9,181,654 | B2 | 11/2015 | Gingras | |
| 2006/0006265 | A1 | 1/2006 | Sabourin et al. | |
| 2015/0375232 | A1 | 12/2015 | Loijas et al. | |

* cited by examiner

REFINER PLATE WITH WAVE-LIKE GROOVE PROFILE

RELATED APPLICATIONS DATA

This application is a nonprovisional of and claims the benefit under 35 U.S.C. § 119(e) of U.S. Provisional Patent Application No. 62/515,430, filed Jun. 5, 2017, the disclosure of which is incorporated by reference herein in its entirety.

BACKGROUND

The field of the disclosure relates generally to refiner plates for lignocellulosic material, and in particular, to such refiner plates having a plurality of alternating bars and grooves, where the groove surfaces include a wave-like profile for improving the efficiency of the fiber reduction process.

Generally speaking, the pulp refining process involves mechanically separating lignocellulosic fibers, such as those found in logs, wood chips, or other similar materials, to create paper or other items. Refiners typically comprise of two discs, one of which is usually a rotating disc (or rotor) and the other being a stationary disc (or stator). Other embodiments may include different arrangements, such as having two discs rotating in opposite directions. In either embodiment, the discs are typically equipped with a number of refiner plate segments mounted to the disc, where the plate segments each have an array of bars and grooves to refine the material. In some embodiments, the grooves include one or more dams to help restrict the flow of material in the grooves and to instead direct the material toward the bars, where the material is refined into smaller pieces, and eventually into individual fibers.

While the conventional refiner plate design with bars, grooves, and dams may be effective at directing the material out of the grooves and toward the bars to improve the refining process, one disadvantage of using dams is that they reduce the hydraulic capacity of the plate as well as reduce the overall useful life of the plate. Accordingly, the present inventor has recognized a need for an improved refiner plate design that address these disadvantages of current designs to improve the refining process. Additional aspects and advantages will be apparent from the following detailed description of example embodiments, which proceeds with reference to the accompanying drawings.

Understanding that the drawings depict only certain embodiments and are not, therefore, to be considered limiting in nature, these embodiments will be described and explained with additional specificity and detail with reference to the drawings.

DETAILED DESCRIPTION OF EXAMPLE EMBODIMENTS

Figure 1:
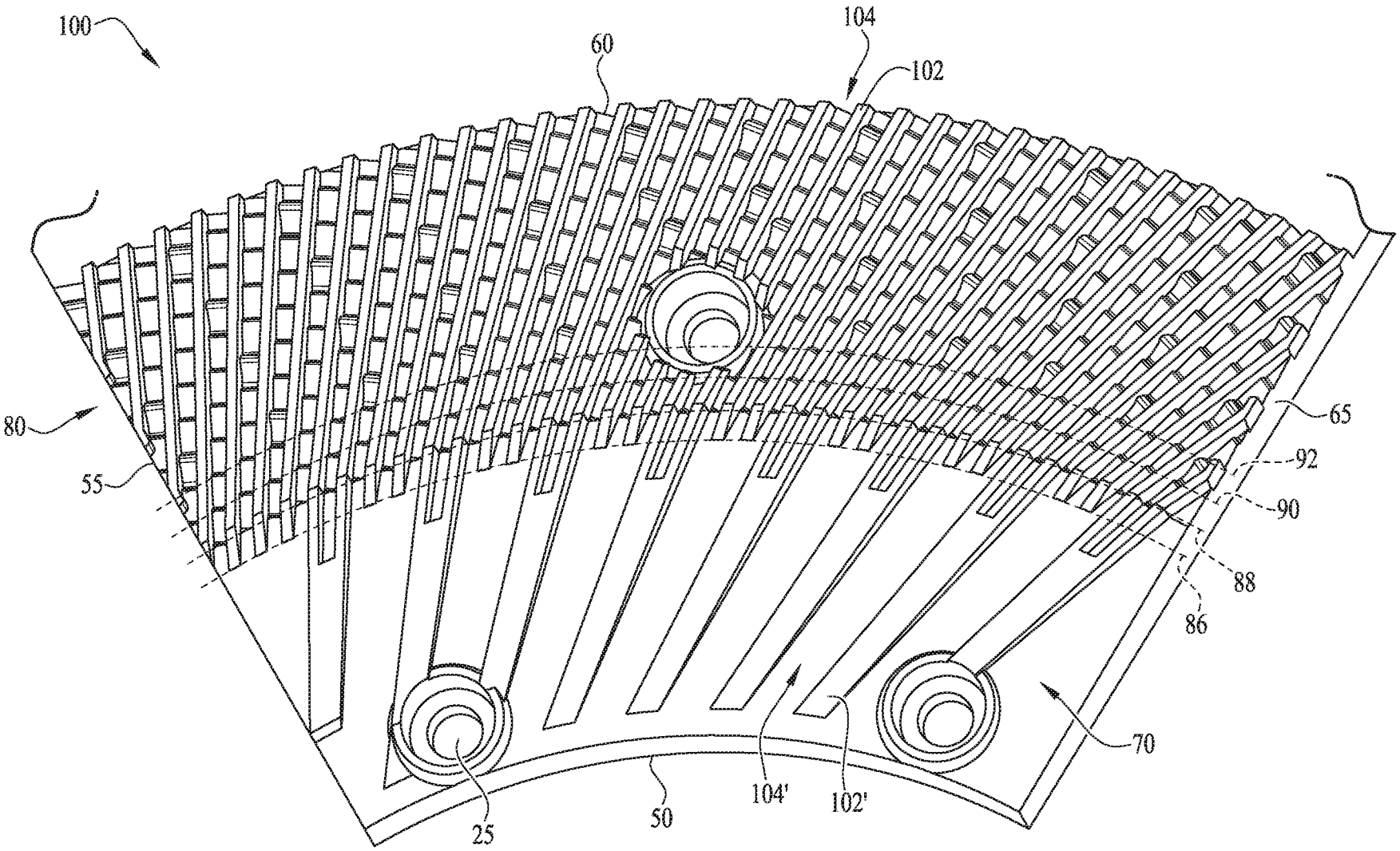
FIG. 1 schematically illustrates a view of a refiner plate in accordance with one embodiment.

With reference to the drawings, this section describes particular embodiments and their detailed construction and operation. The embodiments described herein are set forth by way of illustration only and not limitation. Throughout the specification, reference to "one embodiment," "an embodiment," or "some embodiments" means that a particular described feature, structure, or characteristic may be included in at least one embodiment of the system or of the components being discussed. Thus appearances of the phrases "in one embodiment," "in an embodiment," or "in some embodiments" in various places throughout this specification are not necessarily all referring to the same embodiment. Further, the described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Collectively, FIGS. 1-6 illustrate additional details and embodiments of a refiner plate segment 100 that may be used in a pulp refining process. As is further explained in detail below, the refiner plate 100 includes a plurality of bars 102 and grooves 104 arranged in an alternating fashion for refining the cellulosic material. In the disclosed embodiments, the bottom or base surface of the grooves 104 includes a plurality of projections or teeth 105 extending generally upwardly, the teeth 105 forming a triangular wave-like profile of at least three sets of alternating high points and low points to improve the efficiency of the refining process, and to better breakdown the cellulosic material as further described in detail below. By having the wave-like teeth 105 within each of the grooves 104, the fibers and shives are directed to the bar edge continually through the refining zone, thereby increasing fiber treatment. In addition, the design of the grooves 104 allows for the removal of conventional dams from the refiner plates, increasing the hydraulic capacity of the plate as well as providing a longer useful life. Moreover, a refiner plate incorporating the design features described below will alleviate issues with potential plugging of pulp by increasing turbulence experienced by the fibers, which reduces the likelihood of fibers accumulating together in one spot. Additional details of these and other embodiments of the refiner plate 100 are described below with reference to the figures.

As is understood in the technical field, a complete refiner plate is typically circular and incorporates multiple refiner plate segments 100. In some embodiments, the disclosed refiner plate design with the wave-like groove profile may be incorporated into each of the refiner plate segments 100. In other embodiments, each of the plate segments 100 may include wave-like groove profiles in a partial zone of the plate segment, or in one entire refining zone section of the plate segment, or in multiple zone sections of the plate segment, as desired. Accordingly, while the foregoing written description may relate to an example refiner plate segment 100 as illustrated in the figures, the foregoing disclosure is not intended to be limited only to the illustrated design, where the wave-like groove patterns are incorporated into the entire plate segment. It should be understood that one having ordinary skill in the art may make other variations to the illustrated plate segment design without departing from the principles of the disclosed subject matter described in further detail below.

FIG. 1 illustrates an example embodiment of a refiner plate segment 100 that may form a portion of an annular refiner plate or disc when combined with other plate segments. As one having ordinary skill in the art understands, the plate segment 100 may be arranged side-by-side with other plate segments (not shown) and bolted or otherwise coupled to the rotor or stator (not shown) via the bores 25. As noted previously, in some embodiments, all of the plate segments of the refiner disc may have identical features as the plate segment 100 described in further detail below, or may instead have portions or zones featuring the same or similar features as the plate segment 100. Accordingly, the following proceeds with particular reference to the illustrated plate segment 100 with the understanding that the same concepts may apply to other plate segments or portions/zones of other plate segments of the refiner plate.

Figure 2:
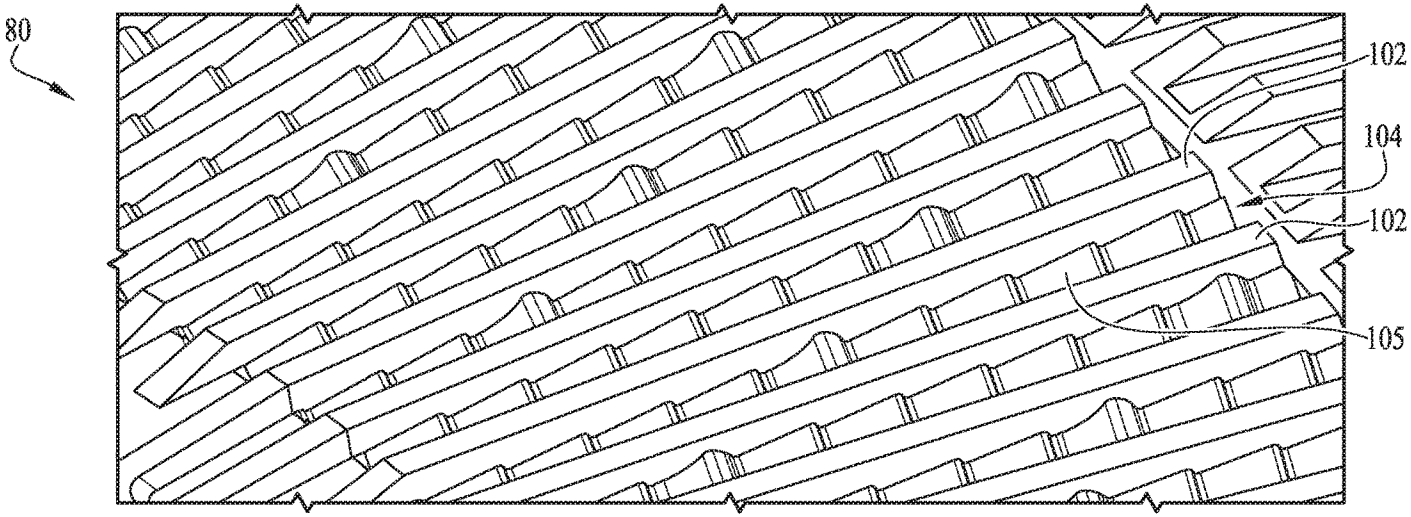
FIG. 2 illustrates an enlarged view of a portion of the refiner plate of FIG. 1.
Figure 3:
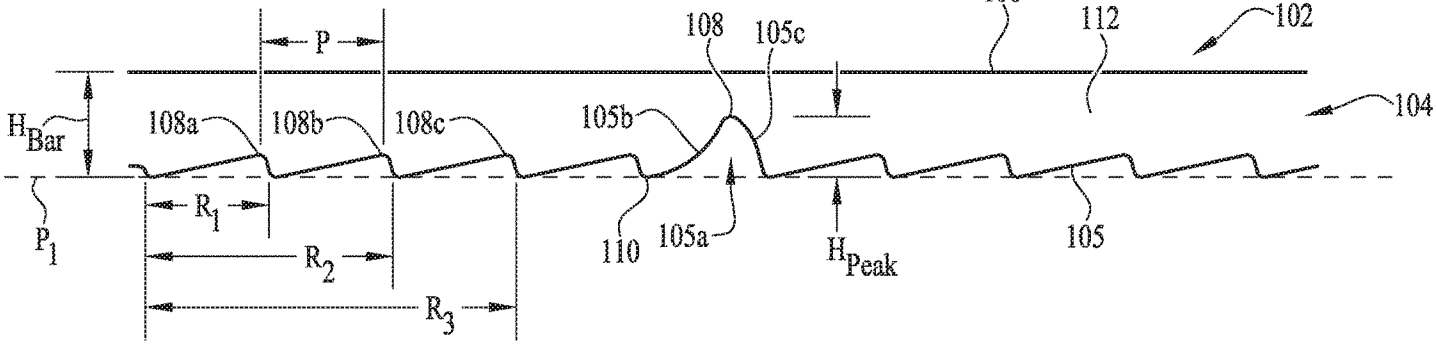
FIG. 3 is a schematic cross-section view illustrating a wave-like groove profile in accordance with one embodiment.
Figure 4:
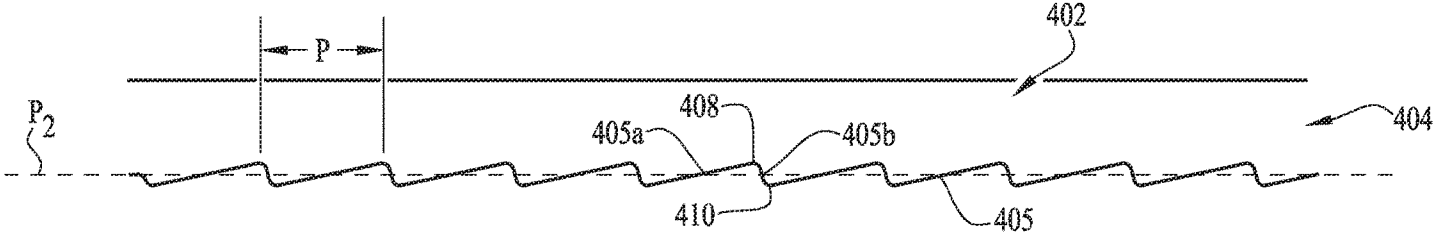
FIG. 4 is a schematic cross-section view illustrating a wave-like groove profile in accordance with another embodiment.

With general reference to FIG. 1, the plate segment 100 includes an inner edge 50 and an outer edge 60, and a first peripheral edge 55 and a second peripheral edge 65 forming the boundaries of the segment 100. A plurality of bars 102 and grooves 104 extend in a generally radial direction along the plate segment 100 from the inner edge 50 toward the outer edge 60. The bars 102 and grooves 104 are arranged in an alternating fashion, such that the grooves 104 separate adjacent bars 102 from one another. The bars 102 and grooves 104 may be arranged in any one of a variety of suitable configurations to refine lignocellulosic material. For example, as illustrated in FIG. 1, in one embodiment, the plate segment 100 may include an inlet zone 70 adjacent the inner edge 50, the inlet zone 70 having a plurality of wide bars 102' and wide channels or grooves 104' therebetween. The wide bars 102' and grooves 104' are adapted to receive larger portions or amounts of cellulosic material and begin the refining process by reducing the size of the material. The bars 102' and grooves 104' in the inlet zone 70 also funnel the smaller material in a radial fashion toward a refining zone 80 of the plate segment 100, where the refining zone 80 has a higher density of bars 102 and grooves 104 as compared to the inlet zone 70. As the annular refiner disc rotates, the partially refined cellulosic material moves radially outwardly from the inlet zone 70 toward the refining zone 80. To help retain the material in the refining zone 80, the grooves 104 include a plurality of teeth 105 (see FIG. 2) forming a wave-like profile that helps impede the flow of material, which has a tendency to move toward the outer edge 50 of the plate segment 100, and instead redirects the material toward the bars 102 for further refinement as needed. With particular reference to FIGS. 2-4, the following description focuses on additional details of the wave-like profile of the grooves 104.

FIG. 2 illustrates an enlarged view of a portion of the refining zone 80 of the refiner plate segment 100 of FIG. 1, and FIG. 3 is a cross-section view illustrating the wavy profile of the teeth 105 in the groove 104 between the bars 102. With collective reference to FIGS. 2 and 3, the following provides additional detail of the features and characteristics of the teeth 105. As best illustrated in FIG. 3, the bars 102 each have a side wall 112 extending from the base surface (not shown) of the refiner plate 100 to a top surface 106 of the bar 102. Generally, the side wall 112 and the top surface 106 of the bar 102 are substantially planar, but one or both surfaces may be slanted or sloped in other embodiments. As mentioned previously, the groove 104 is positioned between adjacent side walls 112 of adjacent bars 102. Within each of the grooves 104 is disposed a plurality of teeth 105. The teeth 105 preferably extend from the side wall 112 of one bar 102 to the side wall of the adjacent bar, such that there are no gaps between the teeth 105 and the side walls 112.

With particular reference to FIG. 3, each tooth 105 includes a peak 108 (e.g., a high point) and a valley 110 (e.g., a low point), where the plurality of teeth 105 together form a wave-like profile within the groove 104 with alternating peaks 108 and valleys 110. The peaks 108 have a height, $H_{peak}$, measured as the distance from the valley 110 to the peak 108, as illustrated in FIG. 3. In some embodiments, the valley 110 may be arranged along a plane $P_1$ that is aligned with a corresponding plane (not shown) of the base surface of the refiner plate 100. In other words, the valley 110 is coplanar with the base surface of the refiner plate 100 as illustrated in FIG. 3. In other embodiments, the valley 110 may instead be aligned along a plane that is offset from and parallel to the plane of the base surface. For example, as illustrated in FIG. 4, the plane $P_2$ indicates the base surface of the refiner plate 100. In FIG. 4, the valley 410 of the tooth 405 may be positioned underneath the plane $P_2$ of the base surface such that the plane $P_2$ extends through a portion of the tooth 405. In other words, the valley 410 extends underneath the base surface of the plate 100. Similarly, in other embodiments (not shown), the valley 410 may instead be offset from the plane $P_2$ such that the valley 410 is above the plane $P_2$ of the base surface.

As noted previously, the peaks 108 may be arranged at any height, $H_{peak}$, (measured as the distance from the valley 110 to the peak 108) relative to the height, $H_{bar}$, of the bar 102. Put another way, the peaks 108 are preferably no taller than approximately ¾ of the total depth of the groove 104 (as measured from the top surface of the bar to the base surface of the groove 104). In some embodiments, the height, $H_{peak}$, of the peaks 108 may range from approximately 10% of the groove depth up to approximately 50% of the groove depth. Preferably, the peaks 108 are not taller than approximately 75% of the height of the bar 102 as measured to the top surface 106 from the surface of the refiner plate 100.

In some embodiments, the peak-to-peak distance (also referred to as the pitch P in FIG. 3) between the alternating peaks 108 is substantially equal within each groove 104 in the refining zone 80 such that the teeth 105 form a structure within the grooves 104 having a uniformly continuous periodic waveform. In other embodiments, the pitch between the alternating peaks 108 may be non-uniform (e.g., the pitch may vary) within a particular groove 104 or all grooves in a particular refiner plate segment. In some embodiments, the pitch P for the alternating peaks 108 within the grooves 104 may be uniform for all teeth 105 and measure approximately 0.125 inches. In other embodiments, the pitch P may instead measure approximately 2.000 inches. In still other embodiments, the pitch P may range from 0.125" to 2.000" and may be uniform for all teeth 105 within a groove 104, or may vary for some or all teeth 105 within a groove 104. It should be understood that the ranges for the height and pitch of the peaks 108 are provided for illustration purposes only, and are not necessarily intended to be limiting.

As noted previously, the refiner plate 100 includes a pattern of alternating bars 102 and grooves 104, each of the grooves 104 having a plurality of teeth 105 positioned therein as illustrated in FIG. 1. With reference to FIGS. 1 and 3, in some embodiments, the teeth 105 are arranged such that the respective peaks 108 and valleys 110 are positioned at corresponding radial distances such that they are aligned relative to one another for adjacent grooves 104. For example, with collective reference to FIGS. 1 and 3, the bottom surface of the groove 104 may have a first peak 108*a* at a first radial distance, $R_1$, measured from a reference arc line 86 extending across the plate 100. The groove 104 may have a second peak 108*b* at a second radial distance $R_2$ measured from the arc line 86, a third peak 108*c* at a third radial distance $R_3$, and so on.

Similarly, an adjacent groove may have teeth with peaks at corresponding radial distances from the reference arc line 86 such that the first peaks for the adjacent teeth 105 within a zone (or partial zone) occur at the same first radial distance relative to the arc line 86. In addition, the second peaks 108 for all grooves 104 also occur at the same second radial distance relative to the arc line 86 and so on. In other words, the grooves 104 each have a wave-like profile comprising alternating peaks 108 and valleys 110 so that there is no phase shift between corresponding peaks 108 and valleys 110 of adjacent teeth 105 in adjacent grooves 104. In this configuration, the refiner plate 100 comprises a plurality of grooves 104, where the position of all peaks and valleys for a band of corresponding teeth 105 is aligned along arc lines that extend across the refiner plate 100 from the first peripheral edge 55 to the second peripheral edge 65. For example, FIG. 1 illustrates three arc lines 88, 90, 92 denoting the location of the respective first, second, and third peaks of the corresponding band of teeth within the respective grooves. As shown in FIG. 1, the arc line 88 illustrates that all of the first peaks 108 of the respective first band of teeth 105 within the respective grooves 104 are all at the same radial distance from the reference arc line 86 (or also relative to the inner edge 50 of the refiner plate 100) such that the first peaks are all aligned relative to one another. Moreover, arc lines 90, 92 also illustrate that the respective peaks of the second band of teeth and third band of teeth for the respective grooves 104 are also aligned relative to one another. As illustrated in FIG. 1, the same pattern holds true for all teeth within a refining zone (or a partial zone).

In other embodiments, the peaks 108 and valleys 110 of the teeth 105 may not be aligned relative to one another as illustrated in FIG. 1, but may instead be offset. For example, the peaks and valleys of teeth in adjacent grooves may be offset from one another such that there is a phase shift between the peaks and valleys of teeth in adjacent grooves. In other words, the peak of one tooth in a first groove may be aligned with the valley of a corresponding tooth in a second groove that is adjacent the first groove, with that valley then being aligned with the peak of another corresponding tooth in an adjacent third groove, and so on. Accordingly, in this configuration, an arc line drawn across the refiner plate (i.e., in a similar fashion as arc line 88) would capture alternating peaks and valleys for adjacent teeth in adjacent grooves.

As illustrated in FIGS. 1-3, the teeth 105 within the grooves 104 may be irregular, that is, the heights of corresponding peaks 108 within a set of teeth 105 in a groove 104 may be unequal. Accordingly, one groove 104 may contain teeth having a peak 108 that may be higher than a corresponding peak of a different tooth 105 within the same groove 104. For example, in some embodiments, the peaks 108 may vary in height from the inner diameter of the plate 100 toward the outer diameter. Varying heights may help create more turbulence to better refine the cellulosic material being processed.

In some embodiments, the teeth 105 with the higher peak 108 may also have a slightly different shape that the remaining teeth 105 in the set. For example, with reference to FIG. 3, tooth 105*a* may have a continuously curved ramp 105*b* extending from the valley 110 upward toward a crest or peak 108 of the tooth 105*a*. The tooth 105*a* may have a curved tail 105*d* that extends to the valley 110 of the adjacent tooth. In some embodiments, the curvature of the ramp 105*b* may be concave to help retain the cellulosic material and/or to restrict its flow to more easily redirect it to the bars 102 for refining, whereas the curvature of the tail 105*d* may be convex to push or urge the cellulosic material away from the tooth 105*a* and avoid potential clogging.

In other embodiments, such as illustrated in the embodiment of FIG. 4, the wave-like arrangement of the teeth 405 may be uniform such that all peaks 408 are at the same height relative to the bar 402, and all valleys 410 are at the same depth relative to the bar 402 within a particular groove 404. In such embodiments, the teeth 405 may all be relatively planar such that the teeth 405 each have a planar ramp 405*a* extending to a crest of peak 408, and then a planar tail 405*b* extending to a valley 410 of the adjacent tooth. In other embodiments, the teeth 105 may include curved portions or profiles instead of being relatively planar, such as described previously with reference to tooth 105*a*.

In still other embodiments, the waveform height of the peaks and valleys may alternate between deep and shallow groupings for adjacent grooves. For example, a first groove 104 on the refiner plate 100 may have teeth 105 with peaks all arranged at a uniform first height. A second groove adjacent the first groove may have teeth with peaks arranged at a second height, where the second height is less than the first height. A third groove adjacent the second groove may have teeth with peaks arranged at a height equal to the first height, and a fourth groove adjacent the third groove may have teeth with peaks arranged at a height equal to the second height, and so on.

It should be understood that other variants may be possible. For example, in one embodiment, the refiner plate may have three grouping depths for the respective peaks of the teeth 105 within a groove 104. In this configuration, the refiner plate 100 would have a groove with a first set of teeth at a first height, an adjacent groove with a second set of teeth at a second height, and a third groove adjacent the second groove with a third set of teeth at a third height, where the first, second, and third heights are different. Thereafter, the height of the peaks in the fourth groove may be equal to that of the first groove, and so on.

Figure 5:
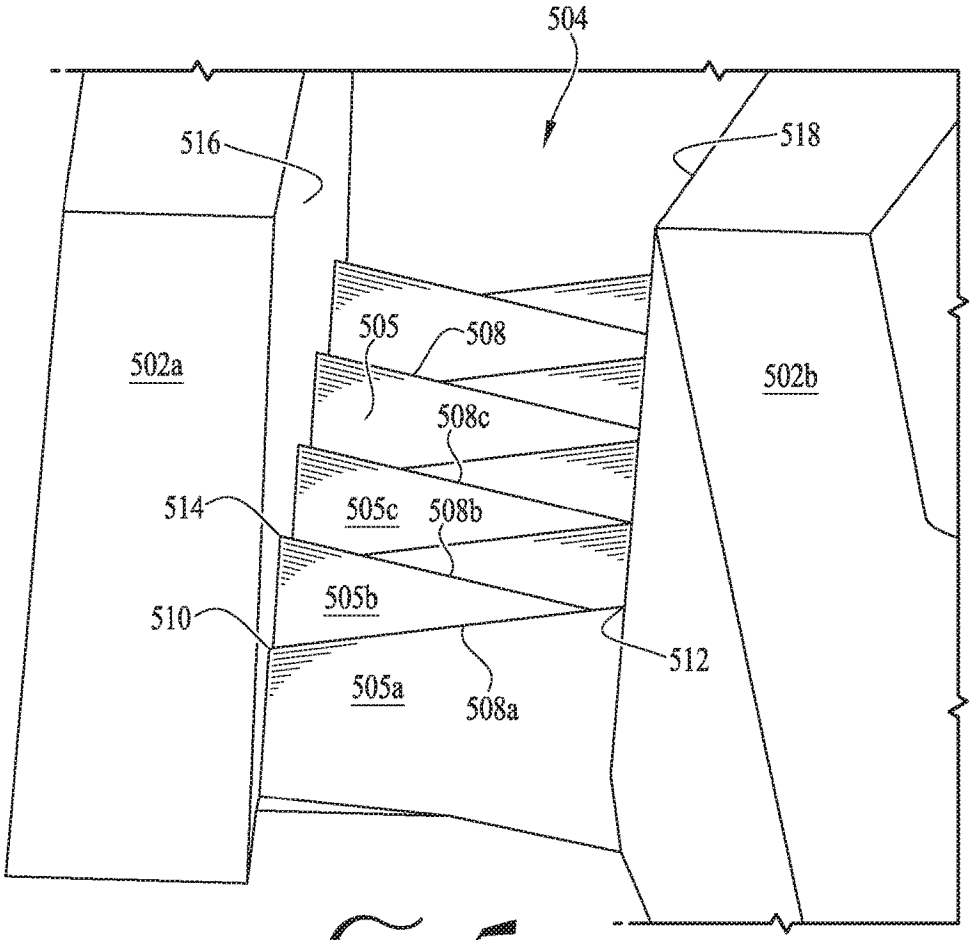
FIG. 5 is an enlarged schematic view of a groove having teeth with a tilted profile in accordance with another embodiment.

As noted previously, the refiner plate 100 may incorporate grooves having a variety of different tooth profiles. FIG. 5 is an enlarged schematic view illustrating a tilted tooth profile for the groove 504 that is different than those discussed previously with reference to FIGS. 1-4. With reference to FIG. 5, the groove 504 includes a plurality of teeth 505 formed between adjacent bars 502*a*, 502*b*. Preferably, the teeth 505 extend to and contact the side walls of the respective bars 502*a*, 502*b* to eliminate any gaps or spaces in a similar arrangement as described previously with reference to FIG. 3. In addition, the teeth 505 each have a similar configuration as the teeth 105 with a ramped section extending upwardly toward a peak and a tail section extending downwardly toward a valley.

With particular reference to FIG. 5, the teeth 505 are arranged in a slanted or tilted orientation such that the respective peaks 508 of the teeth 505 are continuously sloped from one side of the tooth 505 to the other side. For example, as illustrated in FIG. 5, a first tooth 505*a* may be arranged such that its peak 508*a* is sloped as it extends from the sidewall 516 of the first bar 502*a* toward to the sidewall 518 of the second bar 502*b*. In this configuration, the peak 508*a* of the first tooth 505*a* may have a first side 510 disposed at a first height relative to the sidewall 516 of the bar 502*a*, and a second side 512 disposed at a second height relative to the sidewall 518 of bar 502*b*, where the second height is greater than the first height such that the peak 508*a* continuously slopes upwardly across the width of the groove 504 from the first bar 502*a* to the second bar 502*b*. In some embodiments, all teeth 505 within the groove 504 may be tilted in the same direction (e.g., from left to right where the shorter side is adjacent the sidewall 516 of the first bar 502*a* and the higher side is adjacent the sidewall 518 of the second bar 502*b*), such that all teeth 505 in the groove 504 are substantially identical to the first tooth 505*a*.

In other embodiments, the tilt direction for successive teeth 505 within the groove 504 may be alternated such that the first tooth 505*a* may be tilted from left-to-right as described above, and a second tooth 505*b* adjacent the first tooth 505*a* may be tilted from right-to-left. For example, with reference to FIG. 5, the second tooth 505*b* may have a first side 514 disposed at a first height relative to the sidewall 516 of bar 502*a*, and a second side (not shown) disposed at a second height relative to the sidewall 518 of bar 502*b*, where the first height is greater than the second height such that the peak 508*b* continuously slopes downwardly across the width of the groove 504 from the first bar 502*a* to the second bar 502*b* as illustrated. A third tooth 505*c* adjacent the second tooth 505*b* also has a sloped peak 508*c* that is preferably the same as the sloped peak 508*a* of the first tooth 505*a*. Preferably, the height of the second side 512 of the first tooth 505*a* and the height of the first side 514 of the second tooth 505*b* are substantially equal, and the height of the first side 510 of the first tooth 505*a* and the height of the respective second side (not shown) of the second tooth 505*b* are also equal such that the slope of the respective peaks 508*a*, 508*b* is of equal magnitude, though in opposite directions as described.

In some embodiments, the teeth 505 may alternate in this fashion along a portion or the entirety of the groove 504 such that the sloped peaks 508 for successive teeth 505 alternate between sloping upwardly from the first bar 502*a* to the second bar 502*b* and sloping downwardly from the first bar 502*a* to the second bar 502*b*. In some embodiments, some or all of the teeth 505 may be rotated relative to a central axis (not shown) extending through the groove 504. For example, in some embodiments, the teeth 505 may be rotated between a range of 0° to 20° relative to the axis. Additional details relating to an embodiment with rotated teeth is described below with reference to FIG. 6.

Figure 6:
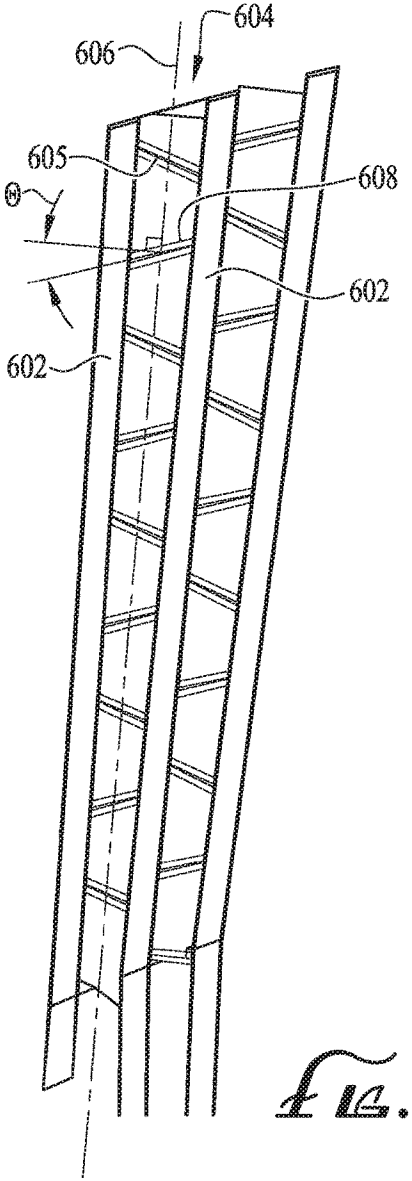
FIG. 6 is an enlarged schematic view of a groove having teeth with a rotated profile in accordance with another embodiment.

FIG. 6 is an enlarged schematic view of a groove 604 in accordance with another embodiment. With reference to FIG. 6, the groove 604 includes a plurality of teeth 605 extending between an adjacent pair of bars 602 in a similar fashion as described with respect to previous embodiments. The teeth 605 may have peaks 608 arranged at a uniform height (similar to the peaks 408 of the teeth 405 of FIG. 4), but with the peaks 608 rotated relative to a central groove axis 610 in an alternating fashion as illustrated in FIG. 6. For example, in one embodiment, the peaks 608 for all teeth 605 may be rotated at an angle Θ relative to a line perpendicular to the groove axis 610, where the angle Θ ranges between 1° to 75°. Preferably, the teeth 605 within a particular groove 604 are all rotated at an equal angle relative to the central axis 610, but in a different direction (e.g., alternating between clockwise and counterclockwise rotation for successive teeth). For example, the first tooth may be rotated clockwise at angle of 30°, and the second tooth may be rotated counterclockwise also at angle of 30°

In some embodiments, the teeth in adjacent grooves may be arranged such that teeth in a corresponding position are rotated at the same magnitude but in opposite directions relative to their respective groove axis. For example, a first tooth in a first groove may be rotated clockwise at an angle of 45° and a corresponding first tooth in a second adjacent groove may be rotated counterclockwise at an angle of 45°. In such embodiments, the second tooth in the first groove may be rotated counterclockwise at an angle of 45° and the corresponding second tooth in the second groove may be rotated clockwise at an angle of 45°, and so on. In a similar arrangement as FIG. 1, in some embodiments, the corresponding teeth (e.g., first teeth, second teeth, etc.) in adjacent grooves are preferably aligned with each other. In such configurations, all corresponding teeth within a refining zone (or portions thereof) of the refining plate are aligned along arc lines extending across the plate. It should be understood that in other embodiments, the teeth in a corresponding position in adjacent grooves may instead be rotated in the same direction, such that all teeth positioned along the arc line would be rotated at the same angle in the same direction relative to the groove axis.

FIGS. 1-6 illustrate various embodiments of a refiner plate segment designed to improve the efficiency of the pulp refining process without sacrificing hydraulic capacity and the life of the plate segment. It should be understood that the embodiments and description provided herein are for illustration purposes only and not meant to be limiting. In other embodiments, the plate segment may include any one of a variety of bar and groove arrangements without departing from the principles of the disclosed subject matter.

In addition, it is intended that subject matter disclosed with reference to a particular embodiment herein can be combined with the subject matter of one or more other embodiments herein as long as such combinations are not mutually exclusive or inoperable. In addition, many variations, enhancements and modifications of the concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. An apparatus for refining fibrous material, the apparatus comprising: a plate segment having a refining zone disposed between an inner edge and an outer edge of the plate segment and between a first and opposing second peripheral edge, the refining zone including a plurality of bars and grooves arranged in an alternating configuration and extending in a generally radial direction along the plate segment from the inner edge toward the outer edge, wherein each groove is positioned between a first bar and a second bar, the first and second bars each having a side wall facing a corresponding groove, the side wall extending upwardly from a base surface of the groove; a plurality of teeth arranged within each groove, each tooth extending across the groove from the side wall of the first bar to the side wall of the second bar, each tooth having a ramp extending upwardly from the base surface of the groove toward a peak and a tail extending downwardly from the peak toward a valley, wherein the plurality of teeth within each groove together form a wave-like profile of at least three sets of alternating triangular peaks and triangular valleys to help impede the flow of fibrous material, wherein at least a first tooth in the plurality of teeth within at least one of the grooves includes a first slanted peak that is continuously sloped as it extends across the groove from the side wall of the first bar to the side wall of the second bar, the slanted peak having a first height adjacent the side wall of the first bar and a second height adjacent the side wall of the second bar, wherein the first height is different from the second height.

2. The apparatus of claim 1, wherein at least a second tooth in the plurality of teeth within the at least one of the grooves includes a second slanted peak that is continuously sloped as it extends across the groove from the side wall of the first bar to the side wall of the second bar, the second slanted peak having a third height adjacent the side wall of the first bar and a fourth height adjacent the side wall of the second bar, wherein the first height is less than the second height such that the first slanted peak of the first tooth slopes upwardly from the first bar to the second bar, and wherein the third height is greater than the fourth height such that the second slanted peak of the second tooth slopes downwardly from the first bar to the second bar.

3. An apparatus for refining fibrous material, the apparatus comprising: a plate segment having a refining zone disposed between an inner edge and an outer edge of the plate segment and between a first and opposing second peripheral edge, the refining zone including a plurality of bars and grooves arranged in an alternating configuration and extending in a generally radial direction along the plate segment from the inner edge toward the outer edge, wherein each groove is positioned between a first bar and a second bar, the first and second bars each having a side wall facing a corresponding groove, the side wall extending upwardly from a base surface of the groove; a plurality of teeth arranged within each groove, each tooth extending across the groove from the side wall of the first bar to the side wall of the second bar, each tooth having a ramp extending upwardly from the base surface of the groove toward a peak and a tail extending downwardly from the peak toward a valley, wherein the plurality of teeth within each groove together form a wave-like profile of at least three sets of alternating triangular peaks and triangular valleys to help impede the flow of fibrous material, wherein each tooth within at least one the grooves includes a slanted peak that is continuously sloped as the peak extends across the groove from the side wall of the first bar to the side wall of the second bar, the teeth arranged such that the respective slanted peaks of each successive tooth alternates between an upward slope and a downward slope as the peak extends from the side wall of the first bar to the side wall of the second bar.

4. An apparatus for refining fibrous material, the apparatus comprising: a plate segment having a refining zone disposed between an inner edge and an outer edge of the plate segment and between a first and opposing second peripheral edge, the refining zone including a plurality of bars and grooves arranged in an alternating configuration and extending in a generally radial direction along the plate segment from the inner edge toward the outer edge, wherein each groove is positioned between a first bar and a second bar, the first and second bars each having a side wall facing a corresponding groove, the side wall extending upwardly from a base surface of the groove; a plurality of teeth arranged within each groove, each tooth extending across the groove from the side wall of the first bar to the side wall of the second bar, each tooth having a ramp extending upwardly from the base surface of the groove toward a peak and a tail extending downwardly from the peak toward a valley, wherein the plurality of teeth within each groove together form a wave-like profile of at least three sets of alternating triangular peaks and triangular valleys to help impede the flow of fibrous material, wherein at least a first tooth in the plurality of teeth within at least one of the grooves is rotated relative to a central axis extending along the groove.

5. The apparatus of claim 4, wherein the first tooth is rotated at an angle between 1° and 75° relative to a line perpendicular to the central axis extending along the groove.

6. The apparatus of claim 4, wherein the first tooth is rotated clockwise at a first angle relative to the central axis, a second tooth adjacent the first tooth is rotated counter-clockwise at a second angle relative to the central axis, and a third tooth adjacent the second tooth is rotated clockwise at a third angle relative to the central axis.

7. The apparatus of claim 6, where the first, second, and third angles are substantially equal.

8. An apparatus for refining fibrous material, the apparatus comprising: a plate segment having a refining zone disposed between an inner edge and an outer edge of the plate segment and between a first and opposing second peripheral edge, the refining zone including a plurality of bars and grooves arranged in an alternating configuration and extending in a generally radial direction along the plate segment from the inner edge toward the outer edge, wherein each groove is positioned between a first bar and a second bar, the first and second bars each having a side wall facing a corresponding groove, the side wall extending upwardly from a base surface of the groove; a plurality of teeth arranged within each groove, each tooth extending across the groove from the side wall of the first bar to the side wall of the second bar, each tooth having a ramp extending upwardly from the base surface of the groove toward a peak and a tail extending downwardly from the peak toward a valley, wherein the plurality of teeth within each groove together form a wave-like profile of at least three sets of alternating triangular peaks and triangular valleys to help impede the flow of fibrous material, wherein a first plurality of teeth within at least one of the grooves includes a slanted peak that is continuously sloped as it extends across the groove from the side wall of the first bar to the side wall of the second bar, the slanted peak having a first height adjacent the side wall of the first bar and a second height adjacent the side wall of the second bar, wherein the first height is different from the second height, and wherein a second plurality of teeth within at least another one of the grooves is rotated relative to a central axis extending along the groove.

9. An apparatus for refining fibrous material, the apparatus comprising: a plate segment having a refining zone disposed between an inner edge and an outer edge of the plate segment and between a first and opposing second peripheral edge, the refining zone including a plurality of bars and grooves arranged in an alternating configuration and extending in a generally radial direction along the plate segment from the inner edge toward the outer edge, wherein each groove is positioned between a first bar and a second bar, the first and second bars each having a side wall facing a corresponding groove, the side wall extending upwardly from a base surface of the groove; a plurality of teeth arranged within each groove, each tooth extending across the groove from the side wall of the first bar to the side wall of the second bar, each tooth having a ramp extending upwardly from the base surface of the groove toward a peak and a tail extending downwardly from the peak toward a valley, wherein the plurality of teeth within each groove together form a wave-like profile of alternating peaks and valleys to help impede the flow of fibrous material; and wherein at least a first tooth in the plurality of teeth within at least one of the grooves includes a first slanted peak that is continuously sloped as it extends across the groove from the side wall of the first bar to the side wall of the second bar, the slanted peak having a first height adjacent the side wall of the first bar and a second height adjacent the side wall of the second bar, wherein the first height is different from the second height.

10. The apparatus of claim 9, wherein at least a second tooth in the plurality of teeth within the at least one of the grooves includes a second slanted peak that is continuously sloped as it extends across the groove from the side wall of the first bar to the side wall of the second bar, the second slanted peak having a third height adjacent the side wall of the first bar and a fourth height adjacent the side wall of the second bar, wherein the first height is less than the second height such that the first slanted peak of the first tooth slopes upwardly from the first bar to the second bar, and wherein the third height is greater than the fourth height such that the second slanted peak of the second tooth slopes downwardly from the first bar to the second bar.

11. The apparatus of claim 9, wherein each tooth within at least one the grooves includes a slanted peak that is continuously sloped as the peak extends across the groove from the side wall of the first bar to the side wall of the second bar, the teeth arranged such that the respective slanted peaks of each successive tooth alternates between an upward slope and a downward slope as the peak extends from the side wall of the first bar to the side wall of the second bar.

12. The apparatus of claim 11, wherein the teeth are arranged to form a plurality of bands of teeth extending across the refining zone, such that the peaks of each tooth within a corresponding band of teeth is arranged along an arc line extending across the alternating bars and grooves from the first peripheral edge to the second peripheral edge of the plate segment.

13. An apparatus for refining fibrous material, the apparatus comprising: a plate segment having a refining zone disposed between an inner edge and an outer edge of the plate segment and between a first and opposing second peripheral edge, the refining zone including a plurality of bars and grooves arranged in an alternating configuration and extending in a generally radial direction along the plate segment from the inner edge toward the outer edge, wherein each groove is positioned between a first bar and a second bar, the first and second bars each having a side wall facing a corresponding groove, the side wall extending upwardly from a base surface of the groove; a plurality of teeth arranged within each groove, each tooth extending across the groove from the side wall of the first bar to the side wall of the second bar, each tooth having a ramp extending upwardly from the base surface of the groove toward a peak and a tail extending downwardly from the peak toward a valley, wherein the plurality of teeth within each groove together form a wave-like profile of alternating peaks and valleys to help impede the flow of fibrous material; and wherein each tooth in the plurality of teeth within at least one of the grooves is rotated relative to a central axis extending along the groove, the teeth being rotated at an angle between 1° and 75° relative to a line perpendicular to central axis extending along the groove.

14. The apparatus of claim 13, wherein a first tooth is rotated clockwise at a first angle relative to the central axis, a second tooth adjacent the first tooth is rotated counter-clockwise at a second angle relative to the central axis, and a third tooth adjacent the second tooth is rotated clockwise at a third angle relative to the central axis.

15. The apparatus of claim 14, wherein the teeth are arranged to form a plurality of bands of teeth extending across the refining zone, such that the peaks of each tooth within a corresponding band of teeth is arranged along an arc line extending across the alternating bars and grooves from the first peripheral edge to the second peripheral edge of the plate segment.

* * * * *